US009640870B2

(12) United States Patent
Klefenz et al.

(10) Patent No.: US 9,640,870 B2
(45) Date of Patent: May 2, 2017

(54) ARRAY ANTENNA

(75) Inventors: Frank Klefenz, Zürich (CH); Ulf Huegel, Herisau (CH)

(73) Assignee: Huber+Suhner AG, Herisau (CH)

( * ) Notice: Subject to any disclaimer, the term of this patent is extended or adjusted under 35 U.S.C. 154(b) by 311 days.

(21) Appl. No.: 14/000,308

(22) PCT Filed: Feb. 7, 2012

(86) PCT No.: PCT/EP2012/052066

§ 371 (c)(1),
(2), (4) Date: Aug. 19, 2013

(87) PCT Pub. No.: WO2012/110366

PCT Pub. Date: Aug. 23, 2012

(65) Prior Publication Data

US 2013/0321229 A1 Dec. 5, 2013

(30) Foreign Application Priority Data

Feb. 17, 2011 (CH) ..... 277/11

(51) Int. Cl.
*H01Q 13/10* (2006.01)
*H01Q 21/00* (2006.01)
*H01Q 21/06* (2006.01)

(52) U.S. Cl.
CPC ..... *H01Q 13/10* (2013.01); *H01Q 21/0087* (2013.01); *H01Q 21/064* (2013.01)

(58) Field of Classification Search
CPC ... H01Q 21/0087; H01Q 13/10; H01Q 21/064
See application file for complete search history.

(56) References Cited

U.S. PATENT DOCUMENTS 3,950,204 A 4/1976 Williams
4,096,482 A * 6/1978 Walters ..... H01Q 21/245 342/373
4,712,110 A * 12/1987 Branigan ..... H01Q 25/02 343/779
4,783,663 A * 11/1988 Rammos ..... H01Q 21/064 343/778
5,321,411 A 6/1994 Tsukamoto et al.
5,499,033 A * 3/1996 Smith ..... 343/700 MS
5,568,160 A 10/1996 Collins
6,127,985 A * 10/2000 Guler ..... 343/771
(Continued)

FOREIGN PATENT DOCUMENTS

CN 2739818 Y 11/2005
DE 101 50 086 A1 4/2003
(Continued)

*Primary Examiner* — Trinh Dinh
(74) *Attorney, Agent, or Firm* — Pauley Erickson & Kottis

(57) ABSTRACT

The invention relates to an array antenna (1), comprising a first plate (2), which has means for distributing an electromagnetic signal to be emitted by the array antenna (1), a second plate (3), which has first openings (7) for conducting the electromagnetic signal to be emitted therethrough, and a third plate (4), which has means (12) used to emit the electromagnetic signal. The second plate (3) is arranged between the first plate and the third plate (2, 4) and is operatively connected to same. The second plate (3) has substantially plane-parallel, smooth lateral surfaces (5, 6), in which the first openings (7) are arranged.

12 Claims, 8 Drawing Sheets

(56) References Cited

U.S. PATENT DOCUMENTS

| | | | | |
|---|---|---|---|---|
| 6,211,838 | B1 * | 4/2001 | Cherrette | H01Q 13/0241 343/786 |
| 6,404,379 | B1 * | 6/2002 | Yu | G01S 13/4418 342/147 |
| 6,861,996 | B2 | 3/2005 | Jeong | |
| 8,558,746 | B2 * | 10/2013 | Thomson et al. | 343/776 |
| 2007/0241962 | A1 | 10/2007 | Shinoda et al. | |
| 2008/0100524 | A1 | 5/2008 | Miura et al. | |

FOREIGN PATENT DOCUMENTS

| | | | |
|---|---|---|---|
| EP | 1 006 608 | A2 | 6/2000 |
| EP | 1 930 982 | A1 | 6/2008 |
| GB | 2 247 990 | A | 3/1992 |
| WO | WO 89/09501 | | 10/1989 |
| WO | WO 2009/093779 | | 7/2009 |

* cited by examiner

ARRAY ANTENNA

BACKGROUND OF THE INVENTION

Field of the Invention

The present invention relates to an antenna, especially an array antenna according to the preamble of the independent claim.

Discussion of Related Art

Array antennas are known from the prior art. These are used for directional transmission and reception of electromagnetic waves.

U.S. Pat. No. 6,861,996 from Microface Co., Ltd. was first published in 2002 and is concerned with a waveguide slot antenna of three-layer construction, which is intended to have a strongly directional characteristic and a high antenna gain. The three plates that form the individual layers are manufactured from plastic and then coated with metal, so that the surfaces are electrically conductive. Alternatively, the individual plates can be made of metal. The waveguide slot antenna comprises a lower first plate, which comprises a first half of a distribution tree on the upper surface. A central second plate comprises a second half of the distribution tree, which in the mounted state cooperates with the first half of the distribution tree. The second plate also comprises through openings. Among other things, because of the distribution tree integrated in the second plate on the reverse side, this has significant fissuring. The third upper plate also has significant fissuring because of the openings necessary for transmission. The parts of the antenna are relatively difficult to manufacture with the required tolerances.

U.S. Pat. No. 3,950,204 from Texas Instruments Inc. was published in 1973 and is concerned with a method for connecting two metallic surfaces with good electrical conductivity, e.g. of plate antennas. The method is described as an alternative to dip soldering, because it can be carried out at significantly lower temperatures. The plate antenna used as an example has a two-layer metal construction.

GB2247990 from British Satellite Broadcasting was first published in 1990 and is concerned with an array antenna with a two-layer construction with a lower and an upper plate. The upper plate comprises recesses, which are used as a horn antenna. The lower plate comprises a distribution tree that is used for signal distribution to the horn antenna. The two plates are joined to each other by soldering or welding. It is a disadvantage that the plates have a complex, likewise significantly fissured construction.

CN2739818Y from the Bejing Yijia Yingye Information Engineering Co. was published in 2005 and discloses a planar antenna with high antenna gain and about 1024 transmitting elements. The antenna has a layered structure. The individual plates are joined by bolts.

US2007241962A from Hitachi Ltd. was first published in 2005 and discloses a radar antenna for use in automobiles. The antenna comprises a metal plate with a plurality of slots. Absorbers for radio waves, which are disposed between the slotted metal plate and the actual antenna, are used to detect directional changes. The slotted metal plate and the antenna are disposed at a distance apart.

EP1 006608A from Technisat Digital GmbH was first published in 2000 and discloses a multilayer antenna arrangement with patch elements that are formed in a conductive top layer. First stimulation elements are formed in a second conductive layer lying thereunder and second stimulation elements are formed in a third conductive layer. The first stimulation elements comprise first supply lines oriented in a first direction and the second stimulation elements comprise second supply lines oriented in a second direction orthogonal to the first direction. Each supply line is oriented to the associated patch element and is electromagnetically coupled to it. The antenna comprises a relatively complex structure with very many layers.

U.S. Pat. No. 5,321,411A from Matsushita Electric Works Ltd. was first published in 1992 and relates to a planar antenna for linearly polarized waves. The antenna has a multilayer structure. The antenna is suitable for a wavelength range of around 500 MHZ.

DE101 50086 from Uhland Goebel was published in 2003 and relates to an array antenna. According to the description the antenna should have a high working bandwidth and a small overall thickness. The described array antenna comprises a regular arrangement of openings in a first electrically conductive or conductively coated body. A second body comprises chamber-like recesses of dual mirror-symmetrical form and is connected to a large area of the first body. The chamber-like recesses are each associated with at least four openings of the first body. The chamber-like recesses have centrally disposed openings on the rear, which form a connection to the second large area of the second body and are used for supply. The antenna has a relatively complex structure and is unsuitable for frequencies in the range 70-80 GHZ, whilst economical manufacture is no longer possible.

SUMMARY OF THE INVENTION

An object of the invention is to indicate an antenna with a relatively simple structure, which also has improved transmission properties and is suitable for frequencies in the range 70-80 GHZ.

This object is achieved by the antenna defined in the independent claim.

In one embodiment the antenna has a layered structure with three plates. A first plate disposed at the rear is primarily used for delivery and fine distribution of the signal to be transmitted. For this purpose the first plate comprises e.g. a distribution tree or similar means. The distribution tree can if required be disposed on multiple planes. A centrally disposed second plate advantageously comprises two plane parallel lateral surfaces (top surface or bottom surface), in which first through openings are disposed that connect the two plane parallel surfaces. The first openings are used to conduct through and transfer the signals to be transmitted to a third plate disposed at the front. The third plate disposed at the front comprises second openings that are operatively connected to the first openings. The third plate disposed at the front is used as a diffusor for transmitting the signal to be sent. In contrast to the prior art, especially the central second plate comprises relatively little fissuring and thus comparatively high mechanical stability. The plates slightly mesh with each other. The plane parallel lateral surfaces of the second plate are suitable for precise, large-area attachment of the first and third plates, e.g. by soldering, gluing or welding. Because only a few parts engage with each other during assembly, any coating damage is prevented. In addition, the deformation of individual plates during assembly can be prevented. This has an advantageous effect on the producibility and the radiation characteristic.

One aim is that the central second plate determines the overall geometry of the antenna substantially and in comparison to the other two plates. This can be influenced by the geometry and/or materials. In a first embodiment the central plate is of higher mechanical stability compared to the first or third plate owing to the geometry. The first and/or the third plates can comprise apertures or recesses for influencing the mechanical stability.

In a second embodiment the central second plate consists of a material with a relatively high modulus of elasticity. For example, metallic materials such as aluminum, brass or other metals or alloys thereof are highly suitable. Depending on the application area, filled or fiber-reinforced plastics are also suitable. Likewise, e.g. material similar to glass or sintered materials, which have a low dependency on external influences, are suitable. A subsequent coating that is highly complex in terms of manufacturing technology is avoided through production from a conductive material.

In contrast to the second central plate, at least the first plate on the rear side and/or the third plate on the front side advantageously consist of a material with a relatively low modulus of elasticity. The shape-determining influence can be reduced or can be mutually neutralized with a suitable, e.g. thin-walled, design and/or through apertures. One aim is that no adverse deformations occur, e.g. in the event of temperature fluctuations.

If required, the central plate can in addition be enclosed by a frame-shaped thickening, which is formed on it or is operatively joined to it. The stability and the dimensional stability can thereby be increased, especially in the event of large temperature fluctuations.

In that the second central plate has a geometrically simple construction, whereby the geometry is essentially limited to two plane parallel surfaces and the first through openings, the manufacturing process can be massively simplified. E.g. the second central plate can thereby be injection molded from plastic or cut out from plate-shaped base material by stamping, laser cutting or milling. Die-casting can also be suitable for the manufacture. E.g. in the event of temperature fluctuations, the second plate deforms more uniformly as a result of its balanced design. According to the invention, the complex geometries are advantageously transferred to the first or the third plate. If necessary, elements of the first and/or third plates can engage in openings of the second plate. Advantageously, at least in the vicinity of the radiating area of the array antenna no elements protrude above the lateral surfaces of the second plate. Recesses and openings are possible.

The first and third plates are advantageously manufactured from plastic, e.g. by injection molding, and if necessary finally coated with an electrically conductive material. In contrast thereto, the central second plate can be cut out or stamped from e.g. metal sheet. Other types of manufacture are possible.

The three plates are advantageously operatively joined together over a large area. Good results are achieved by soldering, welding, ultrasonic welding or gluing. Depending on the area of application, other methods may be suitable.

Because of the simple construction and the low mutual influence of the structures, antennas can be implemented with a relatively large bandwidth. In one embodiment these amount to e.g. 20% in the E Band (71-86 GHz). Furthermore, the structure according to the invention enables the greatest possible antenna gain for a given antenna area/size. This enables e.g. the minimal antenna gain in directional radio mode in the E band specified by standards, in Europe of a minimum of 38 dBi (ETSI Standard) or in the USA of a minimum of 43 dBi (FCC Standard), to be easily achieved. The construction according to the invention enables furthermore a compact, reliable design for short-range point-to-point connections with visibility in the region of around 2 km, which is very robust against external influences. Other dimensions are possible.

If required a mechanical reference can be operatively connected to the transmitter or the central second plate. The mechanical reference can be implemented for rapid alignment as the optical adjustment of the major transmission direction, so that the alignment time of the two antennas relative to each other, e.g. by means of a laser and/or a telescope, is reduced to a minimum. Compared to earlier (purely electrical) alignment, the time required for the alignment can be reduced from a few hours to a few minutes.

One of the main problems with the antennas known from the prior art is that it is difficult to manufacture these with the necessary precision and while maintaining the target tolerances. The dimension of the structure is scaled to the frequency of the antenna. One problem is that the individual plates at frequencies around 80 GHz are so thin that their mechanical stability is critical. Even warping/bending of the plates by a millimeter (approx. ¼ wavelength) leads to a significant degradation of the transmission characteristic and the antenna is unusable. Moreover, it is absolutely necessary that continuous contact between the plates is ensured along the hollow conductor structures. Compression with screws, such as proposed in e.g. U.S. Pat. No. 6,861,996, will not lead to uniform contacting in said dimensions likewise because of the mechanically weaker structure. Moreover, deformation of the transmitting surface is to be expected because of the mechanical point loads.

Contacting by welding of the plastic parts as in GB2247990 would be conceivable, but fails at the subsequent precise metallization of the existing pipe structure. This approach is not feasible from an economical viewpoint and in relation to process safety. E.g. 10 to 20 process steps/baths are necessary for wet chemical metallization of plastics. The use of high-strength materials, e.g. metals or composite materials, is not possible in an efficient method for the delicate structures required with the antennas known from the prior art.

In one embodiment the necessary precision of the structure is achieved by using a plate of a material of relatively high strength (high modulus of elasticity) arranged in a sandwich. For this purpose the central plate is simplified in its geometry so that cost-effective manufacture of a low distortion, mechanically stable plate is possible.

The adaptation structures for the distribution networks are advantageously completely relocated in the upper and lower plates, so that the central plate remains a planar plate with some openings (can be manufactured e.g. of stamped or laser-cut sheet metal or composites such as e.g. printed circuit board). For this purpose the distribution network mentioned in U.S. Pat. No. 6,861,996 is produced with more compact ridge waveguides instead of rectangular waveguides. Thus the aspect ratios in the lower plate remain at a ratio that can still be manufactured cost-effectively for electroplating. Moreover the useful bandwidth of the network increases.

Furthermore, because contacting by stacking and screwing is critical, there is another advantage with this solution: the planar central plate can easily be provided with soldering paste or conductive glue by methods that are common in the circuit board industry, so as to ensure uniform continuous contacting of the hollow conductor structures between the plates.

In one embodiment the array antenna contains a first plate, which comprises a hollow conductor structure for distributing an electromagnetic signal to be transmitted by the array antenna. A second plate comprises first openings for passing through the electromagnetic signal to be transmitted. A third plate is used as a diffusor and comprises means that are used for (directed) transmission of the electromagnetic signal. The second plate is disposed between the first and the third plates and interacts with them over a large area. The second plate advantageously comprises two essentially plane parallel lateral surfaces that are slightly fissured to not fissured, especially near the first openings. The second plate is advantageously designed, or is manufactured from a material having a higher modulus of elasticity than the material from which the first and/or the third plates are made, so that the second plate geometry determines the coverage area of the array antenna. The second plate is e.g. made from metal or a plastic, which is at least partly electrically conductively coated to conduct the electromagnetic signal through. The first and/or the third plates can be made e.g. of plastic, which likewise is coated at least partly electrically conductively or is itself sufficiently electrically conductive. Depending on the target operation, the first openings can have a constant or variable diameter. If required, elements formed on the first plate and/or the third plate can protrude into the first openings to influence the characteristic. The means disposed in the first plate for distributing the electromagnetic signal to be radiated is advantageously a distribution tree of hollow conductors (hollow conductor structure). The hollow conductors are formed by channel-like recesses disposed in the first plate. The channel-like recesses can be disposed on the side facing the second plate and/or on the side facing away from the second plate. In the case of the arrangement at the rear the operative connection to the front of the first plate, or the first openings in the second plate, is ensured via further openings. The plates of the array antenna are advantageously operatively joined over a large area by gluing, soldering or welding. The second plate can be operatively directly or indirectly joined to an alignment device that is used for the mutual alignment of two array antennas.

BRIEF DESCRIPTION OF THE DRAWINGS

Using the figures below the invention is explained with the use of exemplary embodiments. In the figures

DETAILED DESCRIPTION OF THE INVENTION

Figure 1:
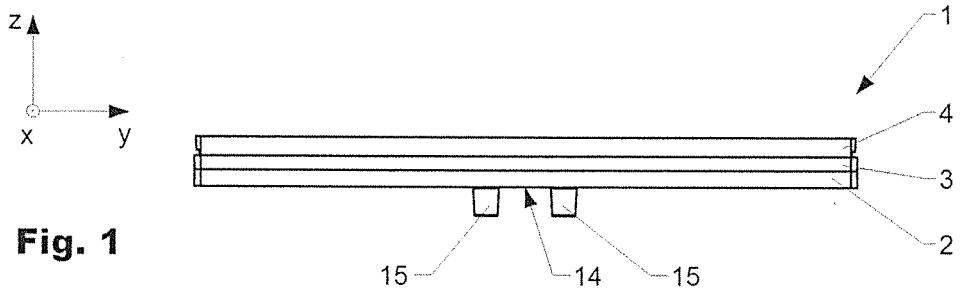
FIG. 1 shows a first embodiment of an array antenna according to the invention in a lateral view.
Figure 2:
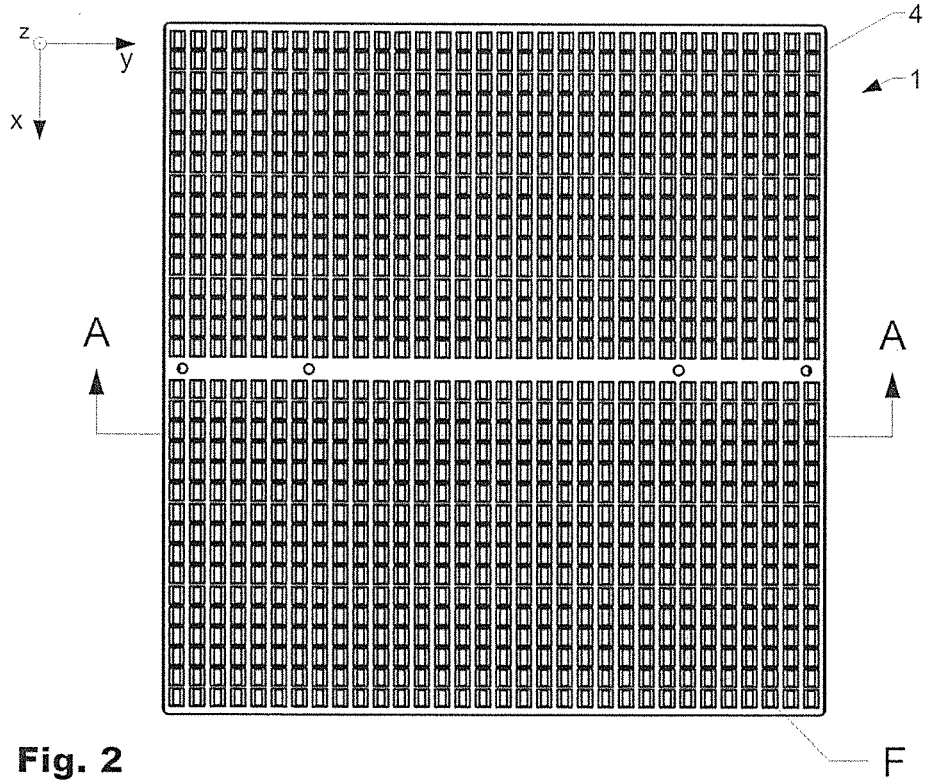
FIG. 2 shows the array antenna according to FIG. 1 in a frontal view.
Figure 3:
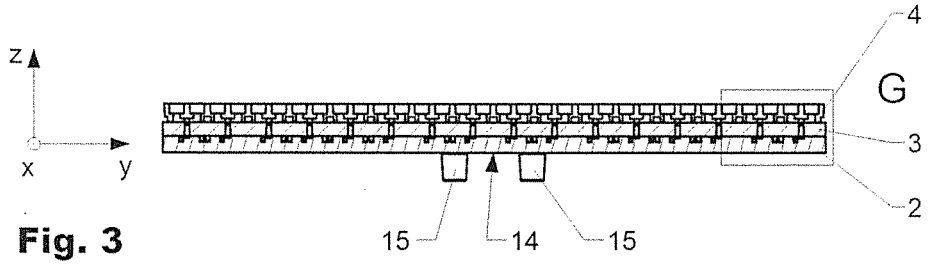
FIG. 3 shows a sectional illustration of the array antenna along intersection AA according to FIG. 2.
Figure 4:
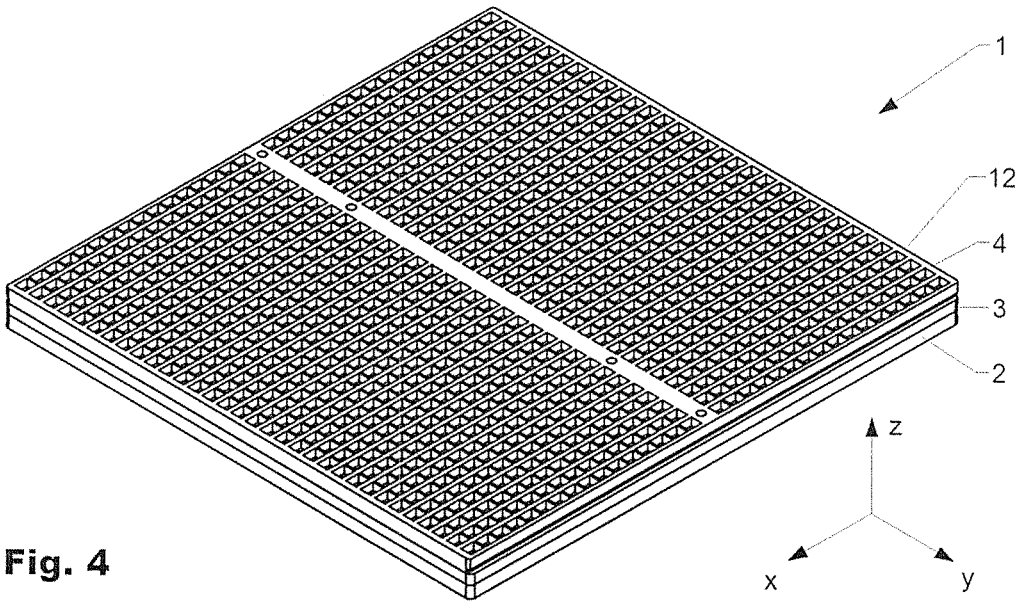
FIG. 4 shows the array antenna according to FIG. 1 in a perspective view at an angle from above.
Figure 5:
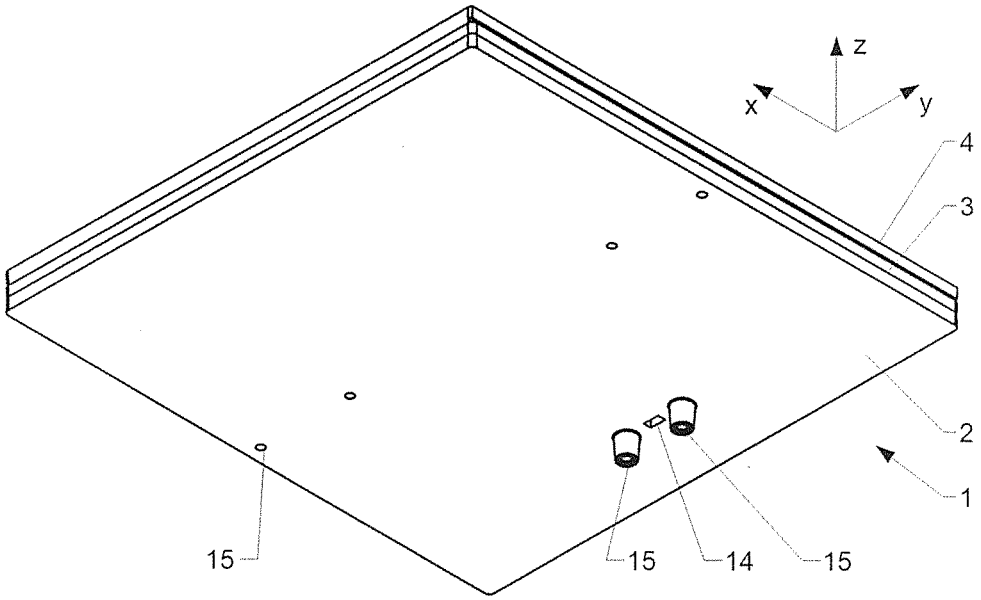
FIG. 5 shows the array antenna according to FIG. 1 in a perspective view at an angle from below.
Figure 6:
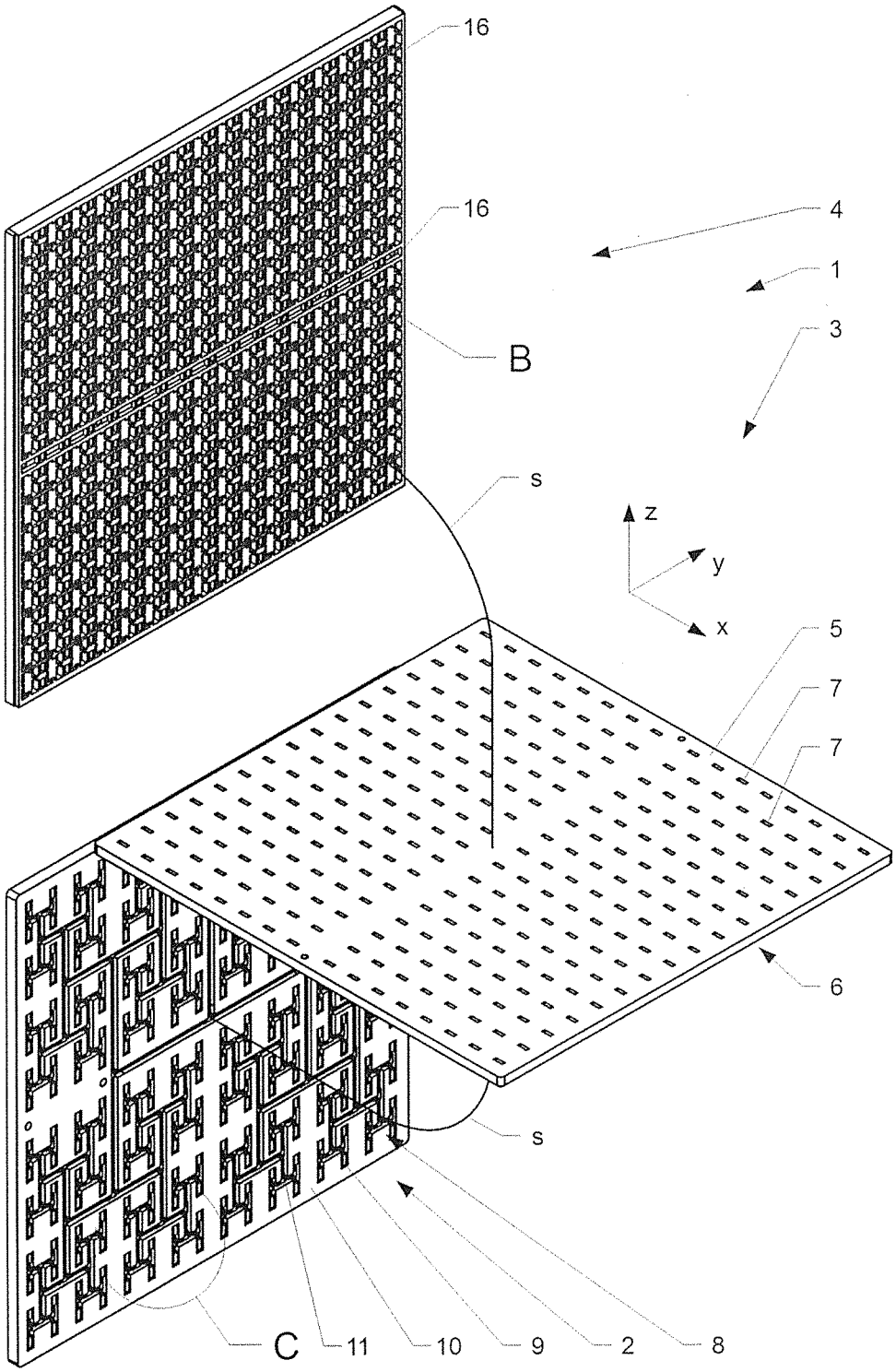
FIG. 6 shows the array antenna according to FIG. 1 in a perspective view at an angle from in front and above in the opened state.
Figure 7:
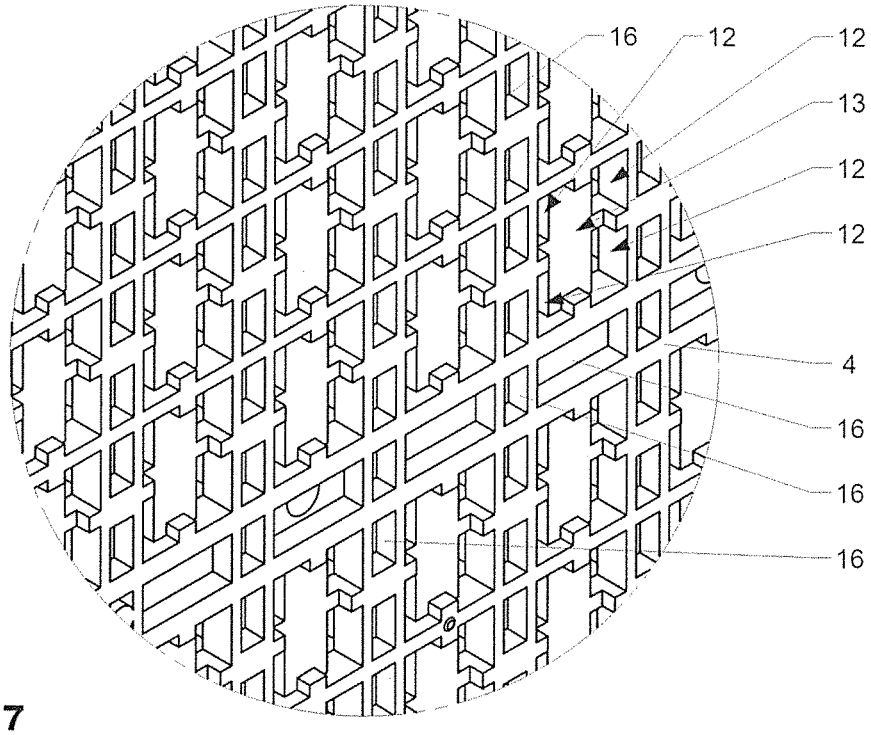
FIG. 7 shows detail B according to FIG. 6.
Figure 8:
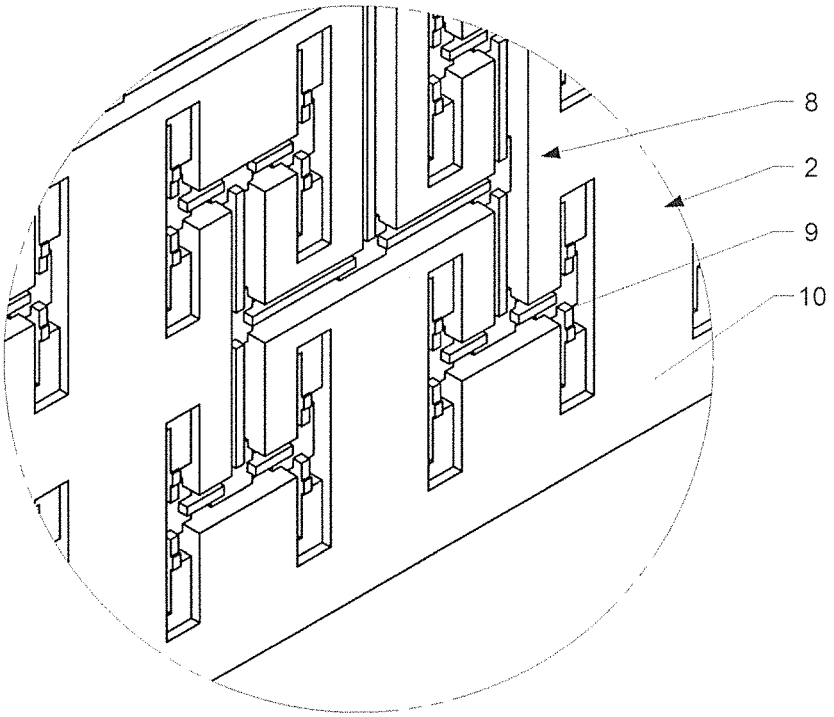
FIG. 8 shows detail C according to FIG. 6.
Figure 9:
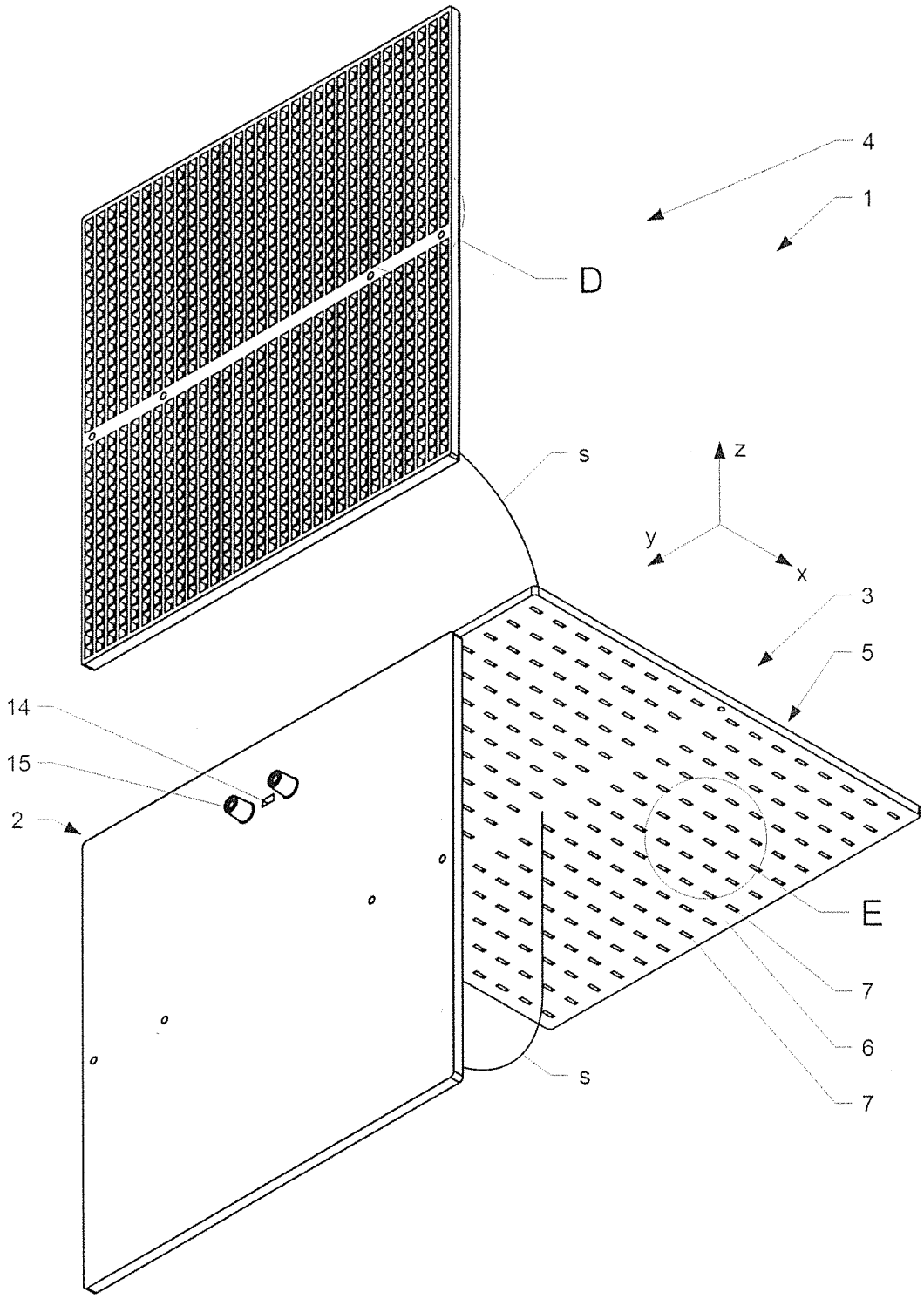
FIG. 9 shows the array antenna according to FIG. 1 in a perspective view at an angle from behind and below in the opened state.
Figure 10:
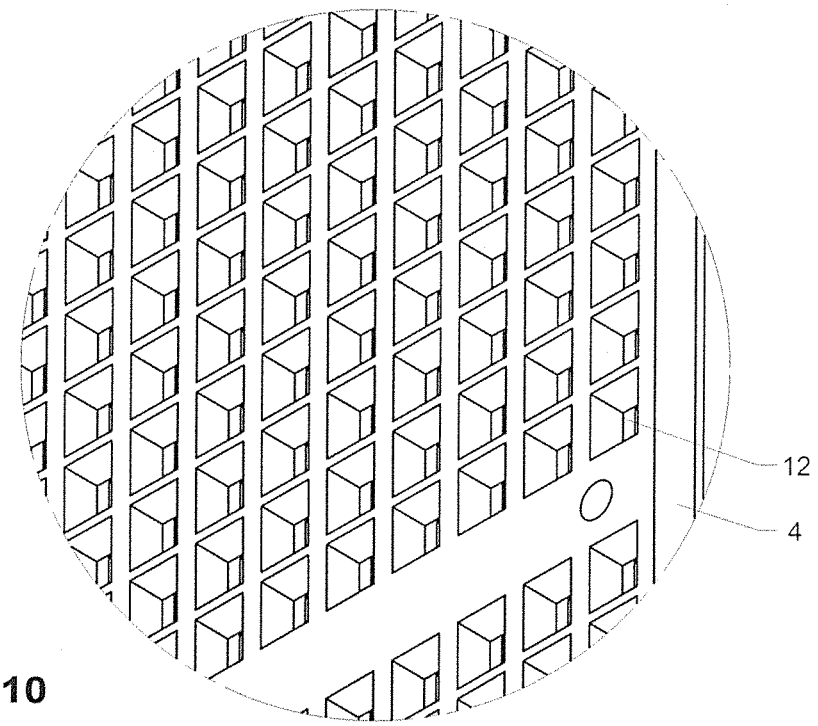
FIG. 10 shows detail D according to FIG. 9.
Figure 11:
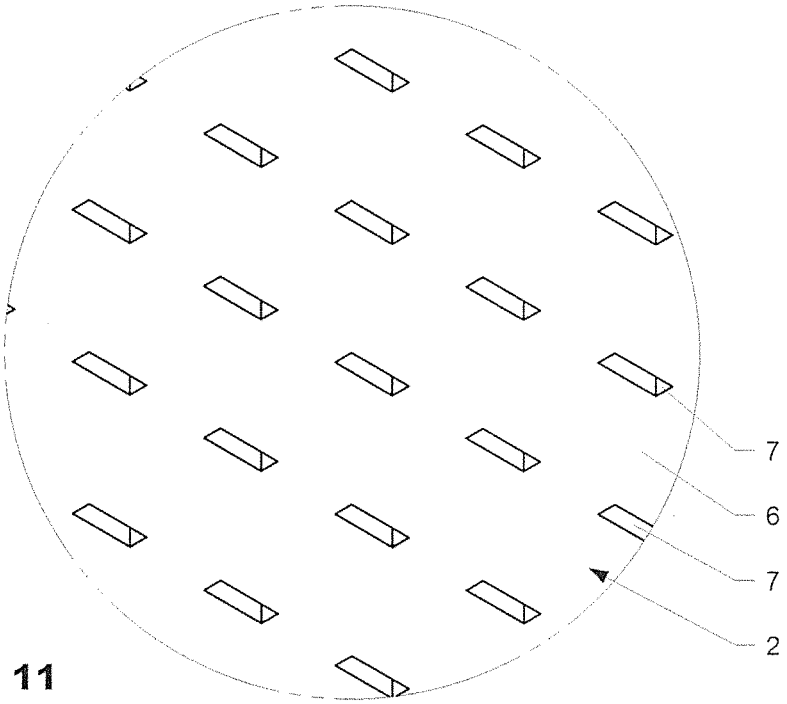
FIG. 11 shows detail E according to FIG. 9.
Figure 12:
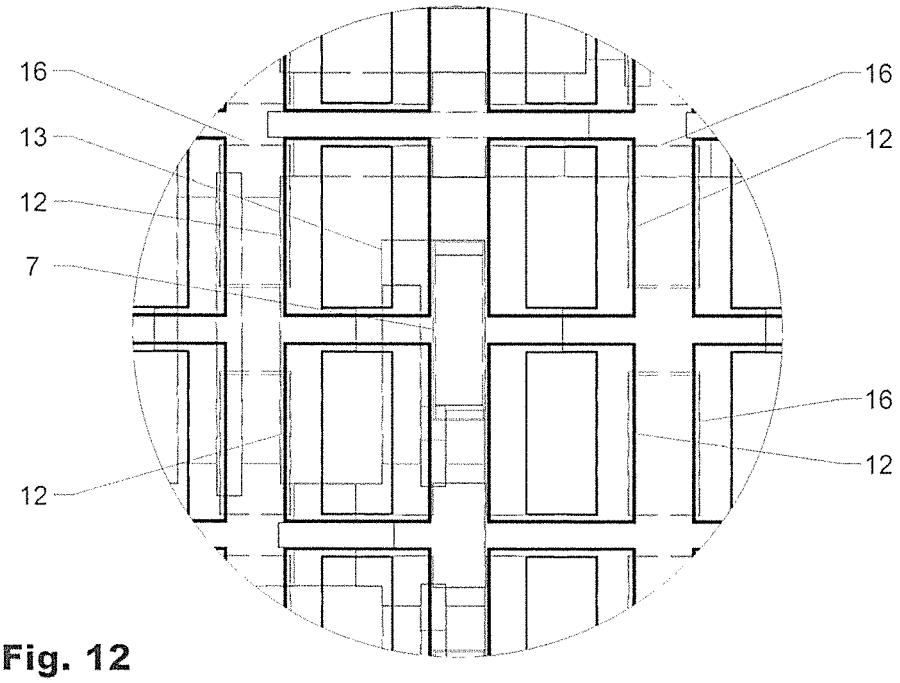
FIG. 12 shows detail F according to FIG. 1.
Figure 13:
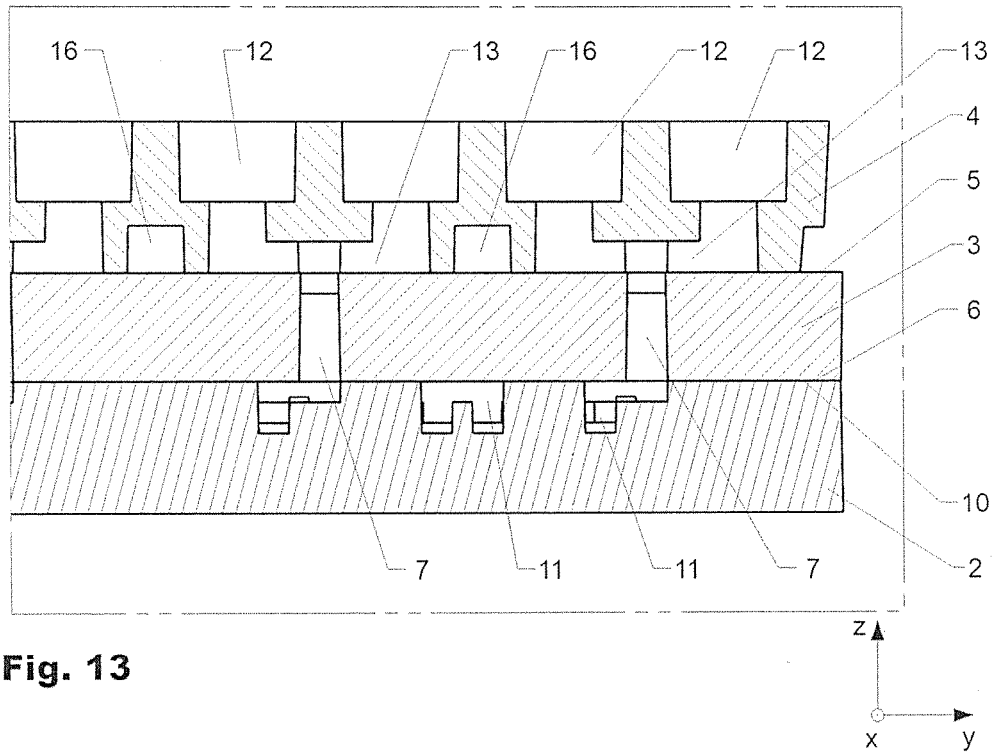
FIG. 13 shows detail G according to FIG. 1.
Figure 14:
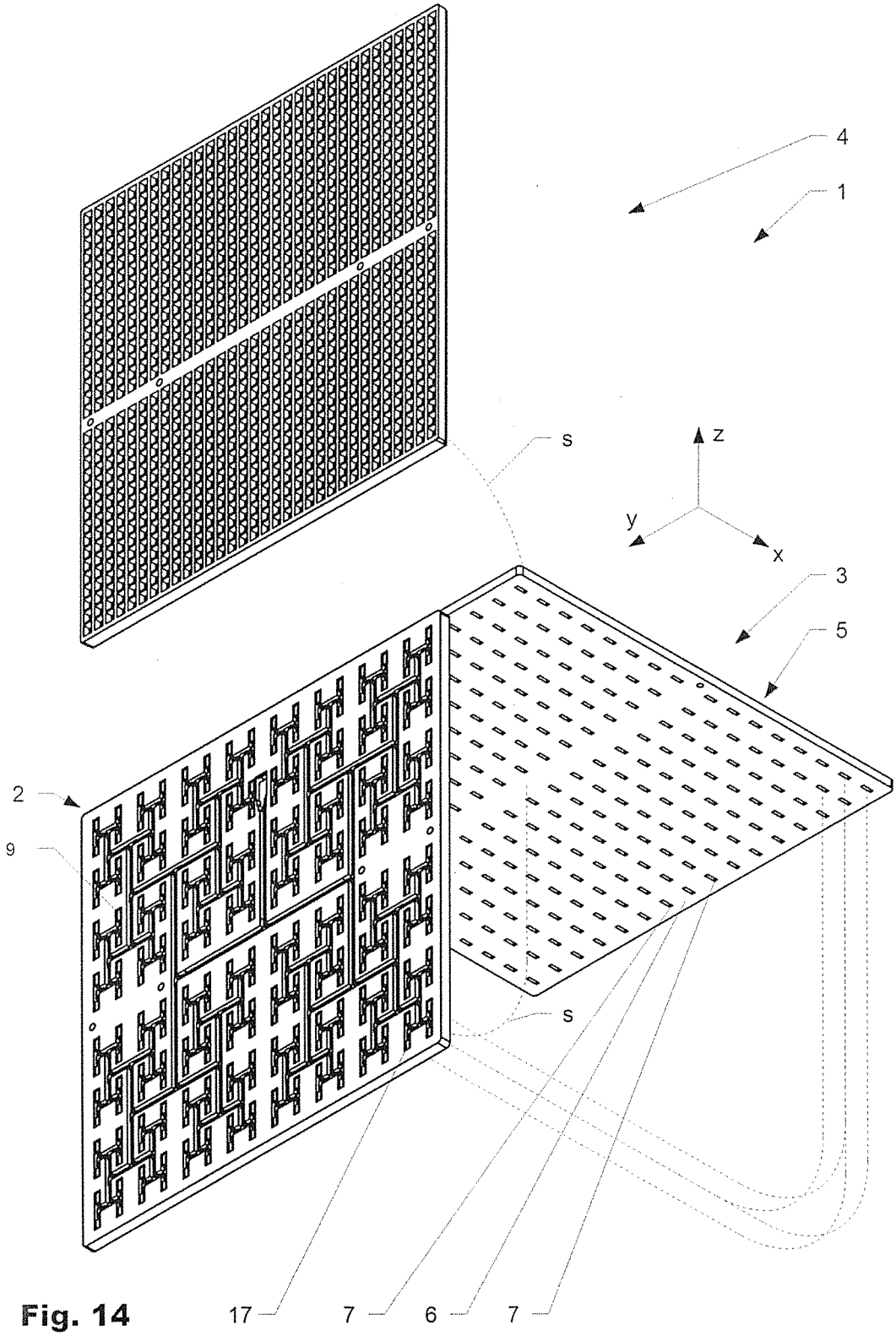
FIG. 14 shows the array antenna according to one embodiment in a perspective view in an opened state.

FIG. 1 shows an embodiment of an array antenna 1 according to the invention in a lateral view and FIG. 2 shows this in a frontal view. FIG. 3 shows the array antenna 1 in a sectional illustration along the intersection AA according to FIG. 2. FIG. 4 shows the array antenna at an angle from in front and above and FIG. 5 shows it at an angle from in front and below. FIG. 6 shows the array antenna 1 in the opened state at an angle from in front and above. The assembly direction is indicated schematically by lines s. FIG. 7 shows detail B and FIG. 8 shows detail C according to FIG. 6. FIG. 9 shows the array antenna 1 in the opened state at an angle from behind and below. FIG. 10 shows detail D and FIG. 11 shows detail E according to FIG. 9. FIG. 12 finally shows detail F according to FIG. 2 and FIG. 13 shows detail G according to FIG. 3. In FIG. 12 the concealed lines are shown in broken form.

As shown in the figures, the embodiment of the array antenna 1 shown has a construction with three plates, wherein a central second plate 3 is disposed between a first rear plate 2 and a third front plate 4.

As can be seen in FIGS. 6 and 9, the central second plate 3 has a simple design compared to the prior art. It consists essentially of a planar, slightly fissured base body 3 with two plane parallel lateral surfaces (top 5 and bottom 6), in which the through openings 7 connecting the two lateral surfaces 5, 6 are disposed. The openings 7 can have a constant cross section or a cross section that varies along their length. In contrast to the prior art the central plate 3 has relatively little fissuring. I.e. the two plane parallel surfaces 5, 6 make up approximately 80-90% of the entire effective cross-sectional area (non-functional openings are not taken into consideration here). In the embodiment shown no elements protrude beyond the lateral surfaces 5, 6.

The central plate 3 is advantageously designed so that its shape determines the geometry or the planarity of the array antenna 1 or reduces the geometry-determining influence of the rear and the front plates 2, 4. This can be achieved by manufacturing the central plate from a material that has a relatively high modulus of elasticity. Metallic materials or fiber-reinforced plastics are highly suitable. As a result of the simple geometry of the central plate 3, this can be manufactured efficiently, e.g. by stamping or in a different way.

In the embodiment shown the rear first plate 2 is used for delivering and distributing the electromagnetic waves to be transmitted (not shown). The rear plate 2 comprises a distribution tree 8, which is formed by H-shaped branched, channel-like recesses 9, which are disposed in the front 10 facing the second plate 3. In the mounted state the recesses 9 form, together with the bottom 6 of the central plate 3, hollow conductors 11 (cf. FIG. 13) for efficient transmission of the electromagnetic waves. The ends of the channel-like recesses 9 correspond to the openings 7 in the second plate 3. The openings 7 are used to transfer the electromagnetic waves to the front third plate 4 (diffusor) which is responsible for transmitting the electromagnetic waves and which is described further below.

In the embodiment shown the front plate 4 is used for directed transmission of the electromagnetic waves (in the figures in the z direction). The front plate 4 comprises horn-like openings 12 for this purpose, which have an operative connection to the through openings 7 via connecting channels 13 disposed on the rear of the plate. As is especially apparent from FIGS. 7, 12 and 13, four horn-like openings 12 each have an operative connection to a first opening 7 and via this to the hollow conductor structure 11 disposed in the first plate 2. Furthermore, here the third plate 4 comprises apertures 16 disposed at the rear, which contribute to the reduction of the mechanical stability and to the reduction of material usage. The first plate can, apart from the channels 9, also comprise additional such apertures if required. With the embodiment shown the signal to be transmitted is passed to the array antenna 1 via a feed opening 14 disposed at the rear. Other arrangements, e.g. on the narrow side of the first plate, are possible. The array antenna 1 is normally installed in a housing, which is not shown here. The array antenna 1 comprises various fastenings 15 for mounting in the housing.

As can be seen, both the first rear plate and also the third front plate 2, 4 have a relatively complex construction compared to the central second plate 3. The first and the third plates 2, 4 are also advantageously designed so that their influence on the geometry is reduced compared to the second plate 3. They can be manufactured e.g. by injection molding from plastic. Their influence on the antenna geometry under changing external influences can be minimized by their design.

The invention claimed is:

1. An array antenna (1) comprising: a first plate (2), which comprises a hollow conductor structure (11) for distributing an electromagnetic signal to be emitted by the array antenna, a second plate (3), which comprises first openings (7) for conducting the electromagnetic signal to the emitted and a third plate (4), which comprises means (12) for emitting the electromagnetic signal, wherein the second plate (3) is disposed between the first and the third plates (2, 4), and includes an operative connection to the first and third plates (2, 4) and the second plate (3) comprises two essentially plane parallel, lateral surfaces (5, 6), in which, the first openings (7) are disposed, wherein at least one of the first plate (2) and the third plate (4) is manufactured from plastic, which is at least partly electrically conductively coated, and the plates (2, 3, 4) are operatively connected to each other by gluing, soldering or welding, such that a continuous contact is ensured between the plates (2, 3,4) along the hollow conductor structure (11), wherein for the transmission of the electromagnetic waves, the third plate (4) comprises four horn-shaped openings (12) wherein the four horn-shaped openings (12) each having a common connecting channel (13) including a L-shape disposed on the rear of the third plate (4) and facing the second plate (3), for connecting the four horn-shaped openings (12) to a common first opening (7) and via the common first opening to the hollow conductor structure (11).

2. The array antenna (1) as claimed in claim 1, wherein the second plate (3) comprises greater mechanical stability compared to the first and/or third plates (2, 4).

3. The array antenna (1) as claimed in claim 2, wherein the first and/or third plates (2, 4) comprise apertures (9, 16), which contribute to a reduction of the mechanical stability.

4. The array antenna (1) as claimed in claim 1, wherein the second plate (3) is manufactured from a material that has a higher modulus of elasticity than the material from which the first and/or the third plates (2, 4) are manufactured, so that a geometry of the second plate (3) is decisive.

5. The array antenna (1) as claimed in claim 1, wherein the second plate (3) comprises metal or a fiber-reinforced plastic, which is at least partly electrically conductively coated.

6. The array antenna (1) as claimed in claim 1, wherein the first openings (7) include a constant or a variable diameter.

7. The array antenna (1) as claimed in claim 1, wherein the hollow conductor structure (11) includes an H-shaped branching.

8. The array antenna (1) as claimed in claim 7, wherein the hollow conductor is formed in channel-like recesses (9) disposed in the first plate (2).

9. The array antenna as claimed in claim 8, wherein the channel-like recesses (9) are disposed on a side facing towards and/or a side facing away from the second plate and include an operative connection to the first openings (7) in the second plate (3) by means of second openings.

10. The array antenna (1) as claimed in claim 1, wherein the second plate (3) is used for the mutual alignment of two array antennas.

11. The array antenna (1) as claimed in claim 1, wherein the first and second plates (2, 3) and the second and third plates (3, 4) are contacted to each other by soldering past or conductive glue.

12. The array antenna (1) according to claim 1, wherein there are four openings (12) for each first opening (7).

* * * * *